United States Patent [19]

Le Jeune

[11] 4,343,313

[45] Aug. 10, 1982

[54] ADHESIVE BRASSIERE AND ITS METHOD OF MANUFACTURE

[76] Inventor: Danielle Le Jeune, Rue du Vignoble, 44450 St Julien de Concelles, France

[21] Appl. No.: 192,385

[22] PCT Filed: Jun. 29, 1979

[86] PCT No.: PCT/FR79/00055

§ 371 Date: Feb. 29, 1980

§ 102(e) Date: Feb. 29, 1980

[87] PCT Pub. No.: WO80/00121

PCT Pub. Date: Feb. 7, 1980

[30] Foreign Application Priority Data

Jun. 30, 1978 [FR] France ..... 78 19579

[51] Int. Cl.[3] ..... A41C 3/00

[52] U.S. Cl. ..... 128/505; 128/463

[58] Field of Search ..... 128/505, 477, 463; 2/314, 311

[56] References Cited

U.S. PATENT DOCUMENTS 3,276,449 10/1966 Morgan ..... 128/505

FOREIGN PATENT DOCUMENTS 1092914 11/1954 France ..... 128/505
76359 10/1961 France ..... 128/463
1301060 7/1962 France ..... 128/505

*Primary Examiner*—Doris L. Troutman
*Attorney, Agent, or Firm*—Sughrue, Mion, Zinn, Macpeak & Seas

[57] ABSTRACT

The brassiere is composed of two symmetrical elements, each supporting one breast. The element comprises a wide part adhesively positioned under the breast and/or on the side, and a thin shoulder-strap adhering, at least at the end, to the back part of the shoulder. The brassiere may be attached to clothing, if desired, to support the same.

12 Claims, 15 Drawing Figures

ADHESIVE BRASSIERE AND ITS METHOD OF MANUFACTURE

The present invention essentially concerns a brassiere constituted by an adhesive sheet, as well as its method of manufacture.

Conventional brassières are constituted by at least one piece of material, equipped, if necessary, with metal boning. Some are strapless but all are constituted by a loop like a belt, closing in front, over the bust.

The presence of this front element prevents their being worn with clothes cut very low at the front, just as, in most instances, the presence of the loop at the back prevents their being worn with clothes cut very low at the back. In addition, their rigidity makes them visible under clothes, which users may wish to avoid.

The brassière according to the invention allows these disadvantages to be remedied. Made of a thin and flexible sheet, although supporting the bust perfectly, it is invisible under the thinnest materials and even under those which are slightly transparent. As there is no connection between the two symmetrical elements, they are invisible for all depths of neckline over the bust, as well as over the back. In addition, the elements adhering to the skin can be used for supporting the actual material of the garment, which offers new possibilities in cut and design.

The principal object of the invention consists of two symmetrical elements, constituted by a sheet or a film adhering at least partially to the skin and with such geometric characteristics as to be suitable, after putting on, for supporting the breasts perfectly while allowing them to assume the required shape.

The invention is a characterised by its use, its shape and its material.

The first part of the description concerns the shape. The brassière element, hereinafter termed element, is most often taken from a plane film. As the breast and the bust are complex in shape, the design of the element has to conform with strict rules so as to give the breast an attractive shape while avoiding local folds and malformations caused by inadequate shaping.

Other characteristics of the invention will appear in the course of the description which follows, with reference to the attached drawings, given by way of non-limiting example, and which will clarify the way in which the invention can be realised.

Figure 1:
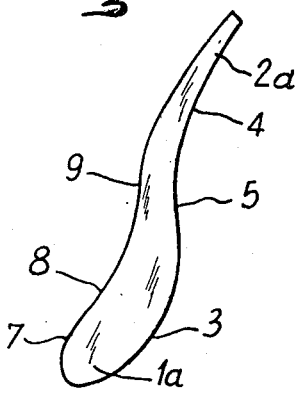
FIG. 1 is a plan view of one element of one embodiment of the invention, the other element being symmetrical.
Figure 2:
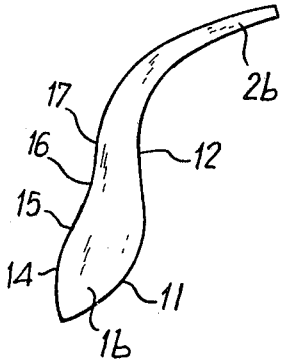
FIGS. 2 and 3 are plan views of variants.
Figure 3:
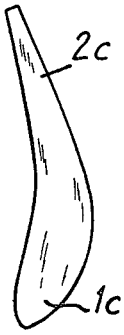
Figure 7:
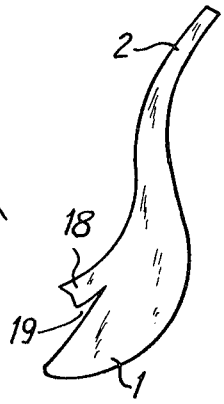
Figure 9:
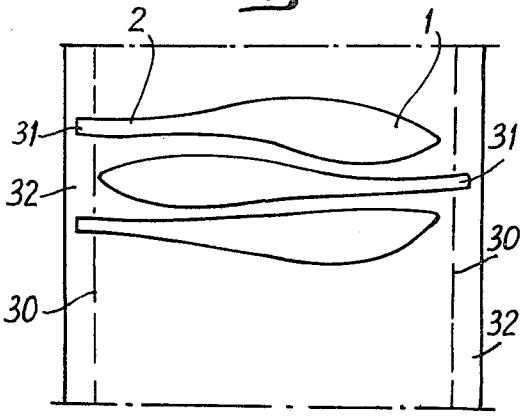
Figure 8:
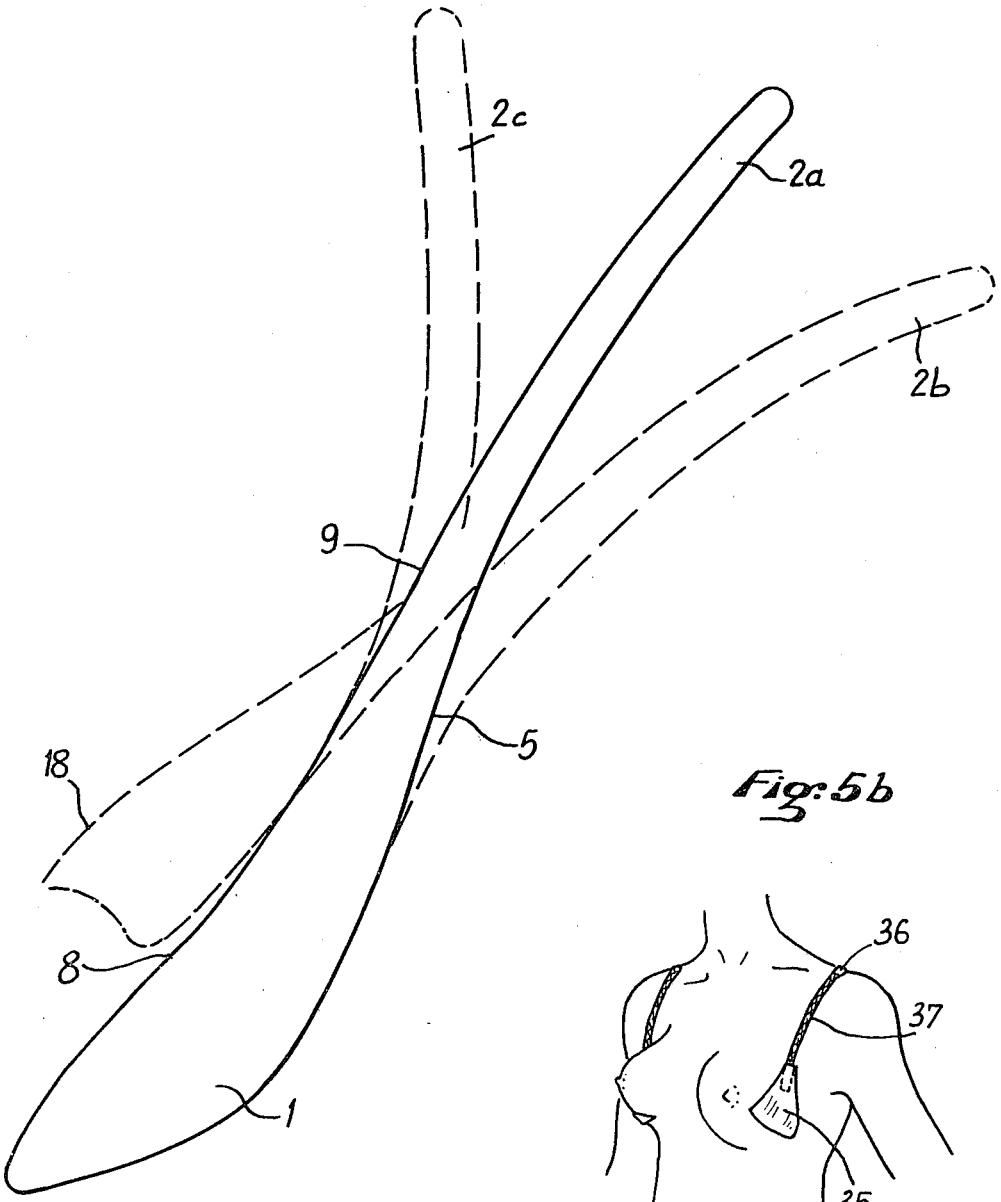
Figure 5B:
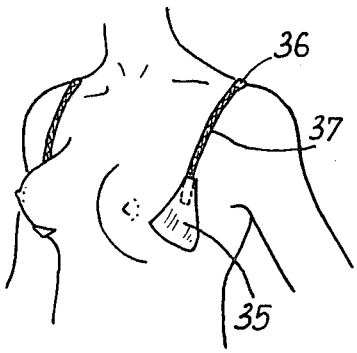
Figure 10:
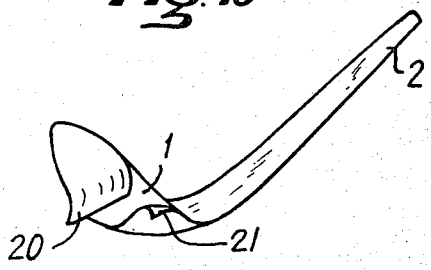
Figure 11:
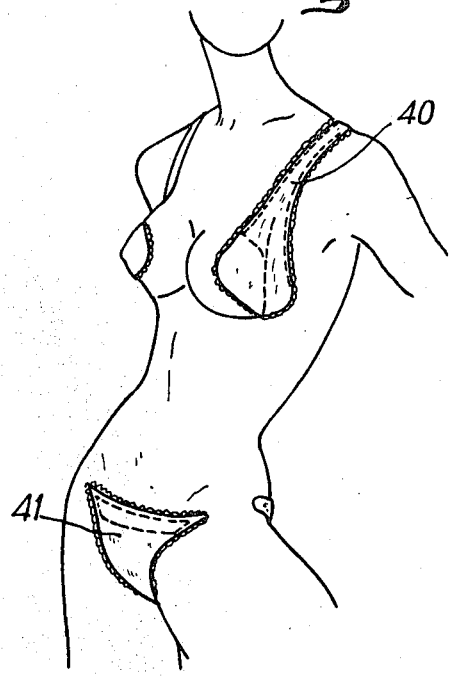
Figure 12:
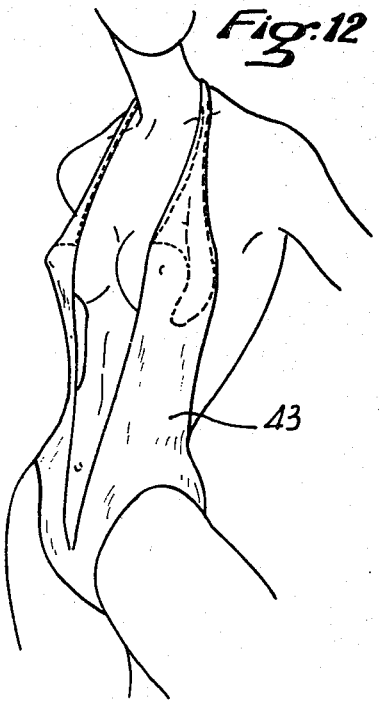
Figure 14:
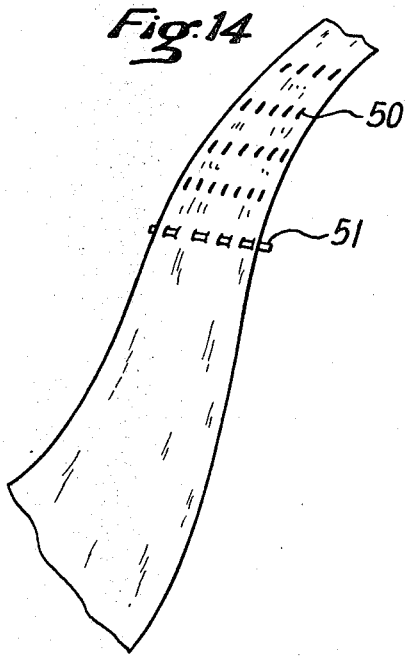
Figure 13:
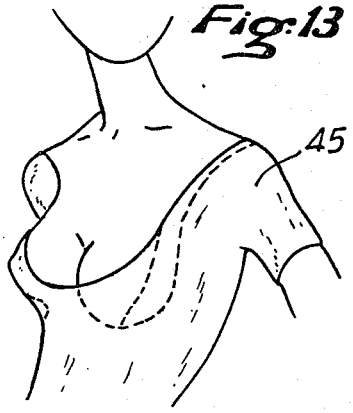

FIGS. 4, 5*a*, 5*b* and 6 are perspective views of the elements of FIGS. 1, 2 and 3 respectively in position on the same bust;

FIG. 7 represents a variant of embodiment applicable to the various elements of FIGS. 1 to 3;

FIG. 8 is a superposition, for comparison with the elements of FIGS. 1, 2 and 3;

FIG. 9 is a plan view of a series of unfinished elements illustrating a method of manufacture according to the invention;

FIG. 10 is a perspective view representing a method of packaging by means of a protective support sheet;

FIGS. 11, 12 and 13 are perspective views of models wearing brassieres according to the invention, each with an associated garment; and FIG. 14 is a partial plan view of a brassiere element provided with means for attachment to clothes.

The basic design is represented in FIG. 1. In the descriptions and drawings, the right side will always be referred to when the article is seen from the front.

The basic element represented in FIG. 1 has an enlarged lower part 1*a* located under and/or on the side of the breast and a narrower upper part 2*a*, going up to the shoulder and then preferably going down the back again, which is required to support the breast and position it at the desired height. The shape is also characterised by a first curve 3 passing substantially at the region of the lower fold of the breast and allowing upwards inflexion, as well as a region 4 from an inflexion point 5, so that the supporting upper part does not come too near the neck, but towards the shoulder, while disengaging the lower part of the articulation of the latter in order to retain easy movement.

The lefthand curve comprises a first curve 7 intended to offer a sufficient area at the film to support the base of the breast. This region 7 approaches the righthand curve so as not to leave too great a width of film which would not follow the curve of the breast at this region. At 8, an inflexion point allows the curve to become progressively parallel to the righthand curve 4. The curvature changes again after a second inflexion point 9, located slightly above the inflexion point 5.

FIG. 2 represents a slightly different variant in which the curves and their inflexion points can be seen. This shape also includes a wide lower part 1*b* and a shoulder-strap 2*b* and is particularly suitable for wide necklines, the upper part being capable of being spread very widely while movement remains very easy. This shape, however, does not allow the same width of neckline above the breasts.

On the righthand curve a large radius 11 recurs under the breast to rise again more sharply on the underpart of the latter; at 12 an inflexion point directs the curve towards the end of the shoulder. The inner part of the curve includes the first part 14 of large radius, the first inflexion point 15 so as to offer sufficient area for the part supporting the underpart of the breast, a curve 16 tending to approach the righthand curve very gradually and a second inflexion point 17 before the curve of the upper part. This displacement of the area supporting the upper part of the breast on the left is essential for avoiding a deformation of the latter when the axis of traction, embodied in the upper part, is biased because of its attachment to the outermost part of the shoulder.

However, the two embodiments of the two first figures have the same distribution of curves and surfaces and the same inflexion points, although of these the points 4 and 17 may, in the extreme, disappear for elements systemmatically approaching nearer to, or even about, the neck. In this case, the element is illustrated by FIG. 3. The lower part 1*c* has the same characteristics as the previous two elements, but the righthand inflexion point and the lefthand upper inflexion point have disappeared to leave the upper part 2*c* bending towards the neck on the left.

Figure 4:
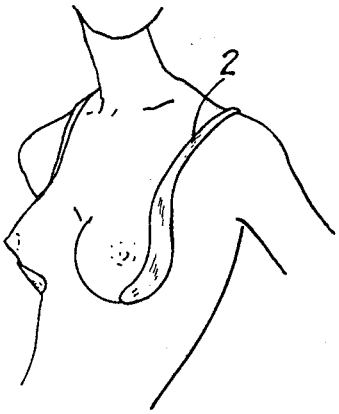
Figure 5A:
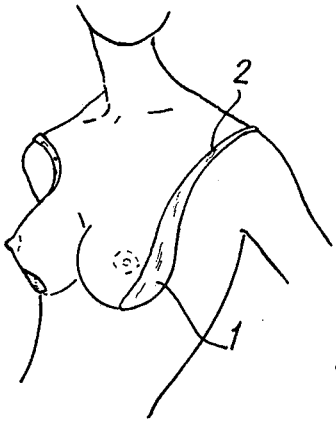

The three instances examined are illustrated again in the drawings of FIGS. 4, 5*a*, 5*b* and 6 for, respectively, the elements presented in FIGS. 1, 2 and 3. In FIG. 4, it can be seen that the shoulder-strap 2 of the article of FIG. 1 goes over the middle of the shoulder, whereas in FIG. 5*a*, the shoulder-strap 2 of the article of FIG. 2 goes outwards, over the edge of the shoulder, and in FIG. 6, the shoulder-strap 2 of the article of FIG. 3 is positioned very near the neck. It is not possible to enlarge the area of adhesive in the region where it covers the curved part of the breast for reasons of geometry connected with the inherent flatness of the sheet; however, it is possible to add surface elements without going beyond the scope of the invention. According to one variant (FIG. 5*b*), the adhesive element is composed of three parts working separately: the 1st is an element 35 adhering to the breast, the 2nd an element 36 adhering to the shoulder, and the 3rd a non-adhesive shoulder-strap 37 connecting the two first.

In a preferred way, the shoulder-strap 37 will be constituted by a sort of strip of material stuck or sewn to the adhesive elements whose geometric and physical characteristics are moreover as previously described. However, in view of the natural flexibility of the shoulder-strap, a symmetrization of the element is possible. The three-part element constituted by the present invention is preferably delivered with two sheets protecting the adheive, detachable simply by peeling, the protective sheet overlapping the adhesive generally at the side of the shoulder-strap.

The element represented in FIG. 7 comprises an extension 18, or additional area of adherence and support, partially detached from the wide part 1, so as to come to be positioned on the upper part of the breast. In this instance, the user places her breast in the required high position before sticking on the additional area, the part thought of as base area having been put in position in the normal way. In this way, this extension of area participates effectively in the supporting of the top of the breast. This type of extension will essentially be used to help hold in place clothes or trimmings of materials such as will be described hereinafter. The extension will be partially detached beforehand from the base area, as is shown in the drawings of FIG. 7, by the presence of the slit 19, so as to allow the film to follow the required curve.

The three elements of FIGS. 1, 2 and 3 are represented superposed in FIG. 8. The lower part 1 is common to the three embodiments, while the upper parts 2*a*, 2*b* and 2*c* are clearly different. The inflexion points 5, 8, 9 of the element of FIG. 1, as well as an extension 18 according to the article of FIG. 7, have been indicated.

According to one characteristic of the invention, the adhesive elements are manufactured from self-adhesive films, generally of the type used in medecine in the form of adhesive strips. An anallergic material will be used for preference.

According to one characteristic of the invention, a film of non-woven fibres will be used, permeable to the air, and transparent enough to assume the colour of the skin after being put on. According to another characteristic, the film is basically flesh-coloured.

According to the invention, a woven support can be used. In this instance, to offer considerable lateral flexibility making putting on and shaping easy and to offer a good mechanical hold longitudinally, it is advantageous to use weft and warp threads with different properties, the element being less extendable in the lengthways direction.

The invention also concerns the packkage of adhesive elements, so as to make them usable by users, and the method of manufacture which follows from the choice of packaging. The elements are symmetrical but most frequently do not have an axis of symmetry each. They are proposed as pairs for use at one time and are presented in sufficient number, equal to or greater than one pair.

A preferred presentation of the invention consists of the following arrangement: the cut elements are stuck to each other by their adhesive face and the last of the pile presenting an adhesive face is stuck to a passive element made of a material of the paraffined or siliconed paper or cardboard type, allowing the last element to be unstuck without damage. The symmetrical elements can be stuck on the other side of the passive element. They therefore present, for reasons of symmetry and reversal, the same external profile as the first series.

In manufacture, a single cut is consequently enough, including the passive element.

According to the invention, and to allow the elements to be detached one by one for use, the end of the shoulder-strap of these or another part of the shape is non-adhesive and can consequently be easily taken hold of. In this instance, a cutting made beforehand, such as of small perforations, for example, allows the surplus part not provided with adhesive to be easily detached, preferably after putting on, if the latter is at the end.

According to a preferred form of the invention, the film is first manufactured in a roll whose width is equal to or slightly greater than each element. This film has the special quality of not being provided with adhesive on at least one of the two edges and on a width of about at least 1 cm. FIG. 9 shows how the cut of the elements is positioned with respect to the strip. The symmetrical elements are disposed by alternating the wide parts 1 and the shoulder-straps 2 so as to reduce wastage of material. There are perforation lines 30 in the strip 32, allowing the end 31 of the shoulder-strap to be easily separated. The adhesive element can be put on the market with an easily detachable protective support sheet, for example a sheet of paper coated with silicone, which is detached just before putting on. But handling an element of adhesive sheet can be inconvenient. One can also advantageously use a support of several parts (FIG. 10) removable independently of each other, preferably in two parts: a part 20 covering the wide lower part 1, and a part 21 covering the shoulder-strap 2. The user first strips off the wide part 1, puts it on, and then puts the shoulder-strap easily in position, removing the rest of the protective sheet. The middle part of the brassière element may or not be adhesive, since the wide part 1 and the end of the shoulder-strap are definitely adhesive.

Such an element lasts a day's wear perfectly and the existing adhesives allow it to be used in water, under a swim-suit.

According to one variant, the element can be manufactured by cutting from a thin sheet made permeable with microperforations.

According to another variant of the invention, the film is no longer manufactured flat but shaped, so that the element is better adapted to the volume of the breast. In this case, manufacture of the support (drying of a paper pulp on mould, polymerisation of a plastic film, vulcanisation of a rubber) and its cutting will be advantageously combined. In particular, methods used for manufacturing latex gloves will be used, for example. Deposition of the adhesive agent can be effected by spraying with electrostatic gun, for example.

According to another variant of the invention, the adhesive film is replaced by a re-usable film or preferably a piece of material of suitable shape, provided at regions in conformance with the invention with an adhesive product applied on each use by means of a brush or an aerosol spray, for example. The adhesive product preferably combines the properties of being sufficiently adhesive, anallergic, and of dissolving in at least one cleaning product.

In conformance with the invention, the new characteristics contributed by these elements allow a far greater freedom in the designing of women's clothes. Besides the absence of inconvenient elements, the adhesive elements allow attachment, or at least the retaining of clothes on these adhesive elements themselves, which is impossible in the case of women choosing to wear on brassière. The new possibilities of attachment will be given in the following examples.

EXAMPLE 1

A piece of material conventionally used for making brassières is attached to the adhesive element. Cut according to conventional rules, for giving them the desired curve, these pieces serve simultaneously to give the whole a better shape and to hide the adhesive element, and if necessary a larger area, which the film is not capable of doing for reasons of deformation and appearance. The drawing of FIG. 11 shows the appearance of such a piece 40, fixed on an element of the type illustrated in FIG. 4 and shown in dotted lines.

The same principle is clearly applicable to swim-suits without going beyond the scope of the invention. The same is true of any increase or decrease in the area of material with respect to the design given as an example, for reasons of styling, for example.

The same principle, apart from the shapes, is usable within the scope of the invention in the making of any clothes, and in particular briefs 41 to match brassières, retaining attachment by adhesive, as represented in FIG. 11.

EXAMPLE 2

Figure 6:
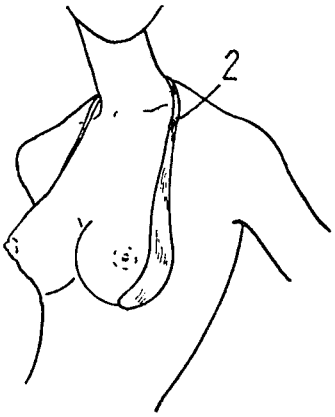

A one-piece swim-suit 43 is cut very low in front and is attached at the top around the neck, as represented in FIG. 12. The adhesive elements of the type illustrated in FIG. 6 are indicated in dotted lines. The material is attached to these elements. Without this attaching, this sort of swim-suit cut is practically unusable, because real movement is impossible if the bust is to remain covered. The same principle is applicable to all clothes and in particular to evening or summer dresses, whether attached around the neck or provided with shoulder-straps.

EXAMPLE 3

The top of a garment 45, a dress or tunic, for example, is cut back on the shoulders and quite deeply in front, as represented in FIG. 13. Usually, this type of garment does not stay on the shoulders and makes the wearing of brassières impossible. According to the invention, it is fixed at least to the shoulders with the adhesive element which, in the form illustrated by FIG. 5, can be pushed back and outwards as far as is required, without inconveniencing movement too much.

Attachment of the garment to the brassière as represented in FIGS. 11, 12 and 13, can be achieved in different ways. Small gaps can be provided in the adhesive. It is thus possible to slide a hook or a clip between the film and the skin.

In another embodiment, the film is manufactured to be provided at least partially with adhesive on the two faces. The material sticks on the outer face thus prepared and is thus held. To improve adhesion of the garment, according to the invention, the latter can be provided, at the regions concerned, with a piece, sewn, for example, whose nature allows a good adhesion.

As a variant, the film is provided at the desired regions with an attaching area, sewn on if need be, so as to allow recovery. The garment is provided with the corresponding element.

In the embodiment represented in FIG. 14, the film is provided with a series of perforations or slits 50, aligned in the attachment region. The film can be non-adhesive along the line of perforations. A strip or flexible rod 51 is introduced before or more generally after putting on, through the perforations, alternately under and over the film. The garment is attached to the rod by means of small hooks or the like. Without going beyond the scope of the invention, perforations can be used directly for fixing the hooks or equivalent elements, without using rods. The same means can be used for fixing pieces of material to briefs.

I claim:

1. A brassiere element for supporting a single breast, comprising: a thin, shaped sheet material, said element being adhesively attached at a lower end thereof to at least the outer side surface of the breast for supporting the same, said element including a strap-like portion extending upwardly from the breast toward a corresponding shoulder of the wearer and terminating proximate the shoulder, at least a portion of said strap-like portion being adhesively attached proximate said shoulder and constituting a shoulder strap.

2. Brassiere element according to claim 1, comprising a first wider part positioned to adhere to the underside of the breast or on the side of the breast and passing outwardly therefrom, a part of decreasing section extending between the shoulder and the breast, and a third part constituting a shoulder-strap, adhering to the skin at least at the end thereof, said three parts together being substantially equal to the surface developed on a plane by the part of the body covered by the element.

3. Brassiere element according to claim 1, characterised by a shape delimited between two principal curved lines meeting at the bottom at an angle or through a curve of small radius and at the top at the end of a shoulder strap, such that:

an outer of said two curved lines having an inflexion point slightly above a horizontal ine passing through the middle of the breast; the portion of the outer curve below said inflexion point substantially following the curve joining the breast to the thorax, the upper portion of the outer curve connecting the side of the breast to the end of the shoulder-strap and avoiding the juncture of the clavicle with the shoulder;

an inner of said two curved lines having two inflexion points, the first substantially at the level of said inflexion point of the outer curve; the second lower inflexion point allowing the inner curve to meet the outer curve, defining a surface sufficient to support the base of the breast.

4. Brassiere element according to claim 1, further comprising means for attaching said element to a garment.

5. Brassiere element according to claim 1, said element being formed from a thin film perforated with holes with a diameter of the order of 1 to 6 mm.

6. Brassiere element according to claim 5, further comprising means for attaching the element to a garment, said attachment means comprising a piece fixed to the garment and including small hooks at the same intervals as said perforations, the hooks being slidable through these perforations between the film and the skin.

7. Brassiere element according to claim 1, wherein at least one part of the element has no adhesive.

8. Brassiere element according to claim 1, including an adhesive-free central part of the element between the region supporting the breast and the end region of the shoulder-strap.

9. Brassiere element according to claim 8, further comprising an individual protective film for each part of the adhesive element.

10. Adhesive brassiere element according to claim 1, comprising three parts, a first adhering to the breast, a second adhering to the shoulder and a third constituted by a non-adhesive strap connecting said first and second parts.

11. Adhesive brassiere element according to claim 10, further comprising two protective sheets covering said first and second adhesive parts, said sheets being overlapped so as to be easily detachable.

12. A method of manufacturing a brassiere element, comprising providing a flexible thin sheet to form the resistant material of the element, coating at least the central part of the sheet with an adhesive, except for at least one edge where a nonadhesive strip is left, applying a protective support to the part covered with adhesive and covering at least part of the non-coated strips, and cutting the elements from the sheet so that each element includes a small nonadhesive part subsequently detachable from the protective support sheet to remove the element from the support.

* * * * *